US010874176B2

(12) United States Patent
Mouquet

(10) Patent No.: US 10,874,176 B2
(45) Date of Patent: Dec. 29, 2020

(54) BELT BUCKLE AND BELT COMPRISING SUCH A BUCKLE

(71) Applicant: HERMES SELLIER, Paris (FR)

(72) Inventor: Philippe Mouquet, Paris (FR)

(73) Assignee: HERMES SELLIER, Paris (FR)

( * ) Notice: Subject to any disclaimer, the term of this patent is extended or adjusted under 35 U.S.C. 154(b) by 79 days.

(21) Appl. No.: 16/312,094

(22) PCT Filed: Jun. 21, 2017

(86) PCT No.: PCT/FR2017/051641
§ 371 (c)(1),
(2) Date: Jan. 29, 2019

(87) PCT Pub. No.: WO2017/220927
PCT Pub. Date: Dec. 28, 2017

(65) Prior Publication Data

US 2019/0159554 A1 May 30, 2019

(30) Foreign Application Priority Data

Jun. 24, 2016 (FR) ..... 16 55929

(51) Int. Cl.
*A44B 11/00* (2006.01)
*A44B 11/22* (2006.01)

(52) U.S. Cl.
CPC ..... *A44B 11/001* (2013.01); *A44B 11/22* (2013.01)

(58) Field of Classification Search
CPC ... A44B 11/001; A44B 11/22; A44C 17/0258; A44C 15/0025; A44C 5/18; A44C 5/20
See application file for complete search history.

(56) References Cited

U.S. PATENT DOCUMENTS 923,316 A * 6/1909 Bair ..... A44B 11/22 24/176
1,553,198 A * 9/1925 Stern ..... A44C 9/00 63/31

(Continued)

FOREIGN PATENT DOCUMENTS

DE 10 2006 026917 A1 12/2007
GB 2 100 332 A 12/1982

OTHER PUBLICATIONS

International Search Report, dated Sep. 21, 2017, from corresponding PCT/FR2017/051641 application.

*Primary Examiner* — Jason W San
(74) *Attorney, Agent, or Firm* — Nixon & Vanderhye

(57) ABSTRACT

Disclosed is a belt buckle including a surround and an ornamental plate arranged in an interior space defined by the surround. The ornamental plate is connected to the surround by a pivot that allows the ornamental plate to be reversed within the surround. The buckle includes a lock to hold the ornamental plate in position with respect to the surround in a first position that exposes a first face of the ornamental plate via an open upper face of the surround, and in a second position that exposes a second face of the ornamental plate via the open upper face of the surround. The lock includes a first element projecting along an edge face of the ornamental plate and a second element projecting on an interior edge of the surround and which are configured to lock together mechanically. Also disclosed is a belt including such a buckle.

12 Claims, 2 Drawing Sheets

(56) References Cited

U.S. PATENT DOCUMENTS

| | | | | | |
|---|---|---|---|---|---|
| 2,585,183 | A * | 2/1952 | Stern | A44C 9/00 | 63/15 |
| 2,666,305 | A * | 1/1954 | Wittmayer | A44C 17/0258 | 63/15 |
| 2,696,689 | A * | 12/1954 | Speck | A44C 5/18 | 40/618 |
| 4,052,773 | A * | 10/1977 | Nesbitt | A44B 11/001 | 24/163 K |
| 4,970,878 | A * | 11/1990 | Lee | A44C 17/0266 | 63/23 |
| 5,102,023 | A * | 4/1992 | Nguyen | A41F 9/002 | 224/152 |
| 5,179,766 | A * | 1/1993 | Matusek | A44B 11/001 | 24/163 K |
| 5,588,310 | A * | 12/1996 | Lai | A44C 9/00 | 63/15 |
| 8,056,780 | B1 * | 11/2011 | Bruns | A44B 11/005 | 224/163 |
| 9,439,480 | B1 * | 9/2016 | French | A44C 5/0015 | |
| 2004/0195281 | A1 * | 10/2004 | Hung | G04B 37/12 | 224/163 |
| 2005/0252240 | A1 * | 11/2005 | Junod | A44C 5/107 | 63/10 |
| 2008/0024976 | A1 * | 1/2008 | Hardson | A44B 11/001 | 361/679.42 |
| 2011/0232044 | A1 * | 9/2011 | Chen | A44B 11/001 | 24/163 K |
| 2012/0284972 | A1 * | 11/2012 | Hafdal | A44B 11/001 | 24/457 |
| 2018/0213895 | A1 * | 8/2018 | Green | A44C 5/20 | |
| 2019/0289969 | A1 * | 9/2019 | Lin | B44C 3/12 | |

* cited by examiner

Fig. 4
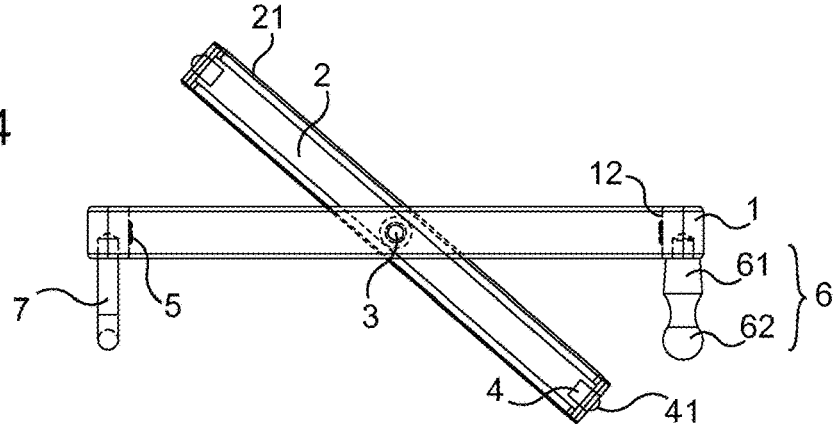
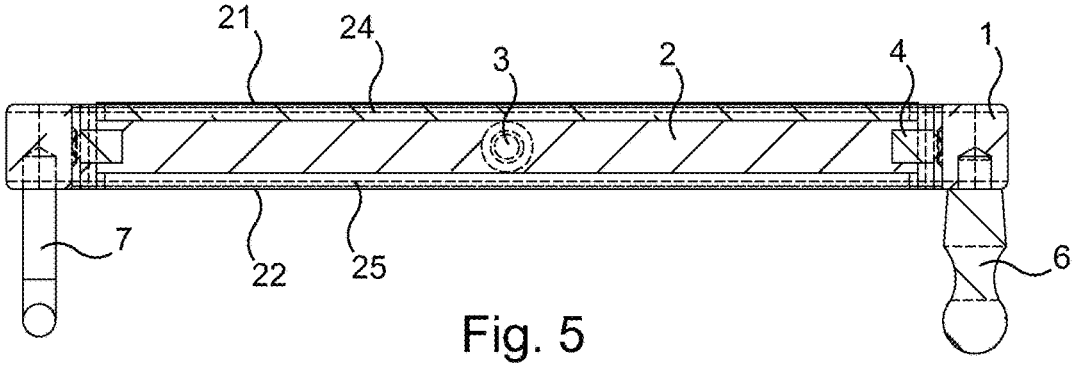
Fig. 5
Fig. 6
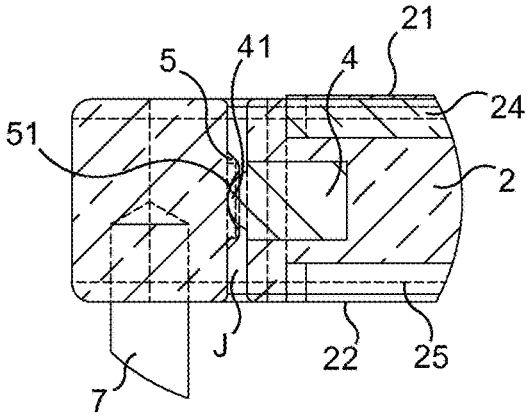
Fig. 7
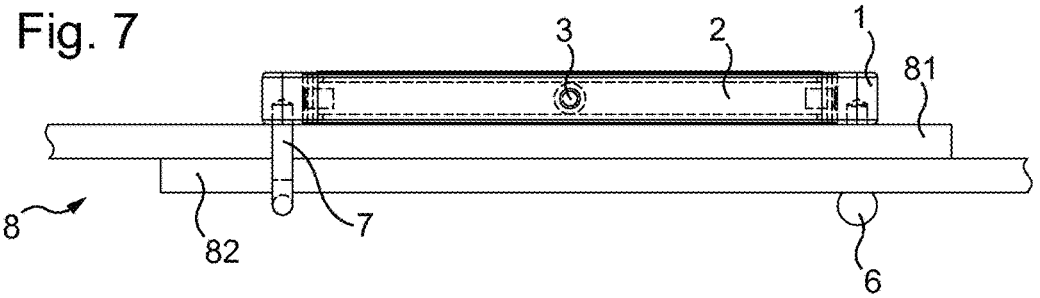

BELT BUCKLE AND BELT COMPRISING SUCH A BUCKLE

BACKGROUND OF THE INVENTION

Field of the Invention

The present invention concerns the field of accessories for apparel and for fashion, and relates more particularly to a buckle for a belt.

Description of the Related Art

Belts used for clothing purposes generally comprise a strap and a buckle. The buckle is securely connected to one end of the belt strap. The buckle has both a functional role, which is to enable the closing and adjustment in length (perimeter) of the belt, and an aesthetic role.

As regards the aesthetic role of the buckle of a belt, this may, as is known, present various aspects and ornaments on an outside face.

Belts are known from the state of the art comprising what is referred to as a reversible buckle, that is to say a buckle able to be turned over relative to the belt strap, so as to choose which face of the strap is visible when the belt is worn. The strap may for example present leathers of different colors and/or aspects on each of its faces.

By turning over the buckle of the belt in order to choose the visible side of the strap, the user may for example match or harmonize the color of the strap with what she is wearing.

As already indicated, the buckle itself has an important role in the general aesthetics of a belt. It thus appeared advantageous to provide a buckle of which the aspect can be changed easily and rapidly, independently of the belt strap. The systems that are known or can be envisioned are not very easy to implement for the user, or are liable to deteriorate the visible components of the buckle, which degrades the aesthetics thereof.

BRIEF SUMMARY OF THE INVENTION

The present invention is directed to providing a belt buckle solving at least one of the aforesaid issues.

Thus, the invention relates to a belt buckle comprising a frame and an ornamental plate disposed in an internal space defined by said frame. The frame comprises an open upper face and an open lower face. The ornamental plate comprises a first face and a second face which is an opposite face to the first face. The ornamental plate is connected to the frame by a pivot enabling it to be turned over in the frame. The buckle comprises locking means configured to hold the ornamental plate in position relative to the frame in a first position exposing the first face of the ornamental plate through the open upper face of the frame, and in a second position exposing the second face of the ornamental plate through said open upper face of the frame. The locking means comprise;

- a first member projecting on an edge surface of the ornamental plate, and
- a second member projecting on an interior rim of the frame delimiting the interior space of the frame;

said first member and second member being configured to mechanically lock relative to each other.

The belt buckle so developed enables the user to choose between two aspects offered respectively by the first face and the second face of the ornamental plate. The choice of the visible face of the ornamental plate is made simply by pivoting the latter within a fixed frame. This operation is easy for the user. Furthermore, the relative locking between the ornamental plate and the buckle frame is achieved by locking means of which the constituent members project respectively from the frame and the ornamental plate, such that successive pivotal movements, locking and unlocking operations of the plate are carried out without risk of damaging the arises of the frame and/or of the ornamental plate.

The first member and the second member may in particular be configured to lock by fitting together of their shapes.

According to an embodiment of the buckle, the first member comprises a pin projecting from the edge surface of the ornamental plate, and the second member comprises a cavity for reception of said pin provided in a protuberance projecting on the interior rim of the frame.

According to an embodiment of the buckle, the first member comprises a pin reception cavity provided in a protuberance projecting from the edge surface of the ornamental plate, and the second member comprises a pin projecting from the interior rim of the frame.

The pin employed may comprise a substantially hemispherical end.

In such a buckle, when the ornamental plate is in the first or in the second position, play is advantageously provided between a periphery of the ornamental plate and the interior rim of the frame, said play being configured to enable the ornamental plate to be turned over without mechanical interference between the ornamental plate and the frame, apart from between the first and second members of the locking means.

The buckle may comprise two locking means which, when the ornamental plate is in the first or in the second position, are disposed along an axis at a right angle to the axis of the pivot connecting the ornamental plate to the frame.

The frame advantageously comprises means for fastening the buckle to a belt strap, and means for closing the belt.

The buckle being configured so as to be fastened by fastening means of the buckle to a belt strap defining a longitudinal direction, the pivot is advantageously oriented along an axis at a right angle to the longitudinal direction.

The frame of the belt buckle may comprise, on its lower face, a prong configured to form fastening means of the buckle to a belt strap and means for closing the belt.

The pivot may comprise two coaxial shafts penetrating via the edge surface of the ornamental plate into the thickness of said ornamental plate which is situated between the first face and the second face of said ornamental plate.

In such a belt buckle, the first face and the second face of the ornamental plate advantageously have different aspects that can be conferred by:

- a surface treatment, such as polishing, knurling, brushing or anodizing; or
- a covering chosen from: varnish, lacquer, paint, metal plating, leather, textile, plastic film; or
- an applied sheet having a surface treatment or a covering.

The invention also relates to a belt comprising a buckle such as already described and a belt strap to which is fastened said buckle.

Still other particularities and advantages of the invention will appear in the following description.

BRIEF DESCRIPTION OF THE DRAWINGS

In the accompanying drawings, given by way of non-limiting example:

FIG. 4 presents a side view of the belt buckle of FIGS. 1 to 3 in a particular configuration;

FIG. 5 presents the belt buckle of FIGS. 1 to 4 in a cross-section view;

FIG. 6 presents a detail view of the cross-section view of FIG. 5;

FIG. 7 presents, in a diagrammatic side view, a belt comprising the buckle of FIGS. 1 to 6 and a belt strap.

DETAILED DESCRIPTION OF THE PREFERRED EMBODIMENTS

Figure 1:
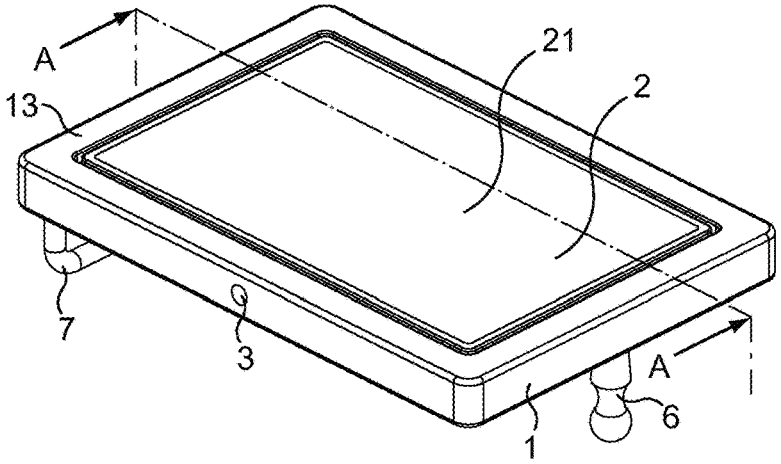
FIG. 1 presents, in a diagrammatic view in three dimensions, a belt buckle according to an embodiment of the invention.
Figure 2:
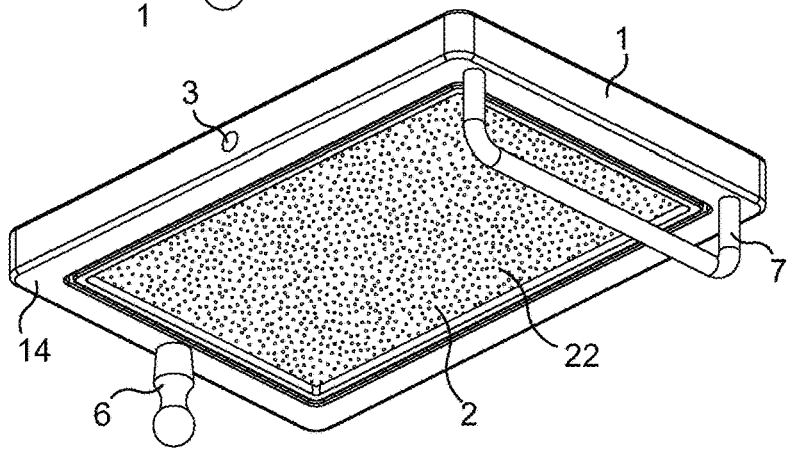
FIG. 2 presents the belt buckle of FIG. 1 from another point of view.
Figure 3:
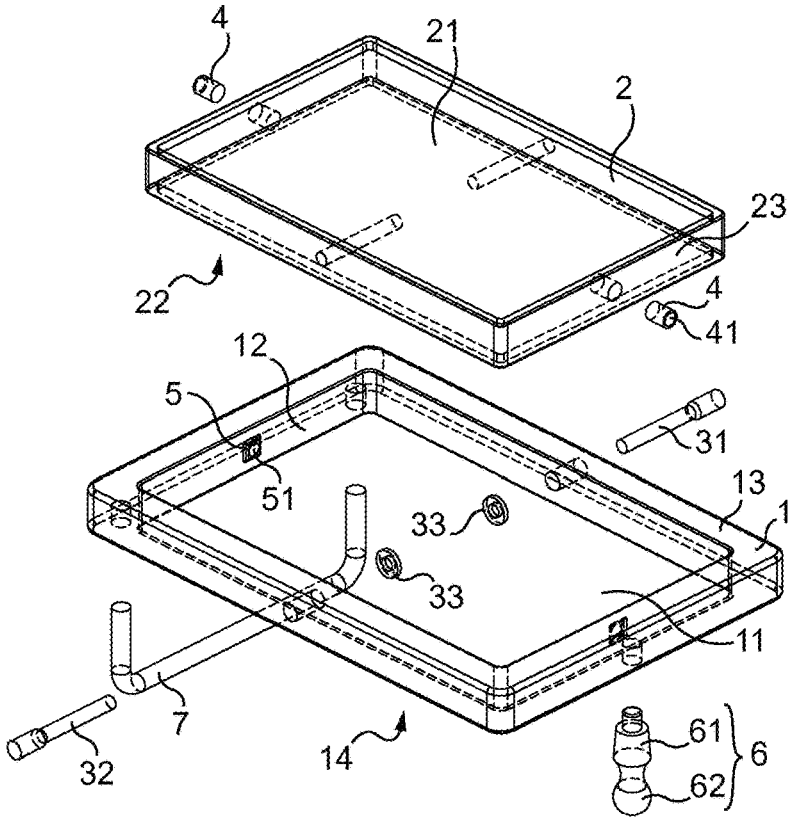
FIG. 3 presents the belt buckle of FIGS. 1 and 2 in an exploded view in three dimensions.

FIG. 1 presents a belt buckle according to an embodiment of the invention in a diagrammatic view in three dimensions, showing the face of the buckle that is visible when it is worn by a user. FIG. 2 presents the same buckle, showing the face of the buckle that is hidden when it is used, that is to say the face of the buckle oriented towards the user wearing a belt equipped with the buckle. FIG. 3 presents the constituent components of such a belt buckle in an exploded view.

The buckle comprises a frame 1, defining an interior space 11 within which is installed an ornamental plate 2. The interior space 11 of the frame 1 corresponds to the volume included between the interior rims 12 of the frame 1, the plane of its upper surface 13 and the plane of its lower surface 14. The upper face 13 and the lower face 14 of the frame 1 are open, such that the interior space 11 of the frame 1 is open at the location of the upper and lower faces of the frame 1.

The frame 1 presents, in the example embodiment represented here, a rectangular general shape, or more exactly a flattened rectangular parallelepipedic external shape. Numerous other forms of frame may be envisioned without departing from the scope of the invention.

The ornamental plate 2 is disposed within the interior space 11 of the frame 1. The ornamental plate 2 is a solid member of flattened shape, comprising two faces, i.e. a first face 21 and a second face 22, and an edge surface 23.

The ornamental plate 2 has a periphery (along the edge surface 23 of the ornamental plate 2) having a shape which may be included within the shape defined by the outside edge 12 of the frame 1. In particular, the shape of the periphery of the ornamental plate may match the shape of the interior space 11, differing in this only by functional play. The functional play may for example be of the order of 0.5 mm between the edge surface 21 of the ornamental plate 2 and the interior rim 12 of the frame 1. The play may be substantially uniform all around the ornamental plate 2.

The ornamental plate 2 may, as in the example embodiment represented here, have a thickness (dimension of the edge surface 23) equal or substantially equal to the thickness of the frame 1 (dimension of the interior rim 12). The buckle in this case has two smooth faces, with no hollows or any component jutting at the location of the open faces of the frame 1.

The ornamental plate 2 is connected to the frame 1 by a pivot 3 enabling the ornamental plate 2 to be turned over in the interior space of the frame 1, so as to orient either the first face 21 of the ornamental plate 2 or the second face 22 of the ornamental plate 2 to the visible side of the belt buckle. In other words, the ornamental plate 2 may be completely pivoted around an axis located in a plane parallel to the upper face 13 of the frame 1. In order to enable the ornamental plate 2 to be fully turned over, the axis of the pivot 3 is advantageously an axis of symmetry of the shape defined by the interior rim 12 of the frame 1 and/or of the shape defined by the periphery of the ornamental plate.

In the example represented here, the pivot 3 comprises two coaxial shafts (along the pivotal axis of the ornamental plate 2 in the frame 1), i.e. a first shaft 31 and a second shaft 32. The first and second shafts 31, 32 pass through the frame 1 and penetrate the thickness of the ornamental plate 2 via its edge surface 23.

In order to facilitate the rotation of the ornamental plate 2 within the frame 1, and to maintain substantially uniform play on either side of the ornamental plate 2, washers 33 may be disposed respectively on the first shaft 31 and on the second shaft 32 between the edge surface 23 of the ornamental plate 2 and the interior rim 12 of the frame 1.

FIG. 4 illustrates the belt buckle in an intermediate configuration on changing the visible face of the ornamental plate 2 by turning it over. In the configuration of FIG. 4, the ornamental plate 2 pivots freely around the axis of the pivot 3.

In order to lock the ornamental plate in a first position in which the first face 21 of the ornamental plate 2 is exposed through its open upper face of the frame 1, and in a second position of use of the buckle in which the second face 22 of the ornamental plate is exposed through the open upper face of the frame 1, the buckle comprises means for locking between the frame 1 and the ornamental plate 2. The locking means represented here employ fitting together of shapes between a first member attached to the edge surface 23 of the ornamental plate 2, and a second member attached to the interior rim 12 of the frame 1.

In the example represented here, the first member is a pin 4 projecting from the edge surface 23, of which the end 41 is configured to be accommodated in a cavity 51 comprised by a protuberance 5 provided on the interior rim 12 of the frame 1.

The frame 1 of the buckle further comprises means for fastening the buckle to a belt strap, in order to constitute a belt. The fastening means comprise a prong 6, configured to be accommodated in a hole provided in the belt strap. The prong 6 is complemented by a loop 7 located on the opposite side of the frame 1 in order to ensure the proper orientation of the buckle relative belt strap.

The prong 6 and the loop 7 are connected to the lower face 14 of the frame 1.

The buckle also comprises means for closing the belt, that is to say means making it possible to adjust the diameter of the belt in use and hold the belt at that diameter. In the example represented here, the prong 6 is configured both to form the means for fastening the buckle onto the belt strap and the means for closing the belt. To that end, the prong 6 has a sufficient length to pass through two thicknesses of the belt strap. Furthermore, the prong 6 has a part 61 that is proximal relative to the buckle, for fastening the buckle to the strap, and a distal part 62 for closing the belt.

The proximal part 61 may have a straight shape or a shape that is slightly flared on going away from the buckle, in order to ensure proper holding of the strap. The distal part 62 may have a rounded end facilitating its insertion into a hole in the belt strap, and a constricted region improving the holding of the belt strap on the distal part 62 of the prong 6.

Advantageously, the loop 7 is dimensioned so as to be able to pass therethrough two thicknesses of belt strap.

FIG. 5 presents the belt buckle of FIGS. 1 to 4 in a longitudinal cross-section view, along the longitudinal plane A-A represented in FIG. 1. A detail view, at the location of the means for locking between the ornamental plate 2 and the frame 1 is presented in FIG. 6.

As represented in FIG. 5, the ornamental plate 2 presents a first face 21 comprising a sheet 24, and a second face 22 comprising a covering 25. The sheet 24 and the covering 25 give the first face 21 and the second face 22 different aspects. For example, the first face 21 may present a lacquered sheet while the second face 22 may present a covering 25 of leather.

The locking of the plate 2 to the frame 1 is illustrated in FIG. 6.

In the illustrated embodiment, the end 41 of the projecting pin 4 is substantially hemispherical, giving the impression of a bead embedded in the edge surface of the ornamental plate.

Corresponding therewith, the protuberance 5 and its cavity 51 advantageously have rounded shapes, enabling the end 41 of the pin 4 to clip into the cavity 51 easily and without deterioration.

Except at the location of the members forming the locking means, play J is provided between the ornamental plate 2 and the frame 1. This play J may for example be of the order of 0.5 mm between the edge surface 21 of the ornamental plate 2 and the interior rim 12 of the frame 1. The play J enables the ornamental plate 2 to be turned over without mechanical interference or contact between the ornamental plate 2 and the frame 1. In particular, the first member of the fastening means (i.e. the pin 4 in the represented example) does not interfere with the interior rim 12 of the frame 1, and the second member of the fastening means (i.e. the protuberance 5 in the represented example) do not interfere with the edge surface 23 of the ornamental plate 2.

FIG. 7 presents a belt comprising a belt buckle such as already described and a belt strap 8. A strap first end 81 passes through the loop 7 and is fastened to the buckle by the prong 6, at the location of its proximal part 61 (not visible in FIG. 7) which passes through a hole that it comprises. A strap second end 82, comprises a succession of holes enabling the adjustment in length of the belt. The belt is closed at the desired length (perimeter) by insertion of the distal part 62 of the prong 6 into a hole of the strap second end 82, said strap second end being passed into the loop 7, under the strap first end 81.

Of course, the invention is not limited to the detailed embodiment described above. Numerous variants may be envisioned without departing from the scope of the invention.

For example, the first and second members of the locking means may be swapped between the frame 1 and the ornamental plate 2. For example, the edge surface 23 of the ornamental plate 2 may comprise a projecting protuberance comprising a cavity, while the interior rim 12 of the frame 1 may comprise a pin 4 of which the end 41 projects from said interior rim 12. Other similar geometries for locking means may be envisioned, and other locking means may be envisioned, provided that the members that compose them (and which are configured to cooperate by fitting together or matching of shapes) project respectively from the edge surface 23 of the ornamental plate 2 and from the interior rim 12 of the frame 1.

The position and the number of the locking means on the interior rim 12 of the frame 1 and on the edge surface 23 of the ornamental plate 2 may vary according to different variant embodiments of the invention.

The pivot 3, although it is preferably oriented transversely relative to the direction of extension of the belt strap, may nevertheless be oriented differently in certain variant embodiments of the invention, for example in the longitudinal direction of extension of the belt strap 8.

Numerous shapes may be envisioned for the frame 1, both for its outer general shape and for the shape of the interior space it defines. For example, the frame 1 may have the general shape of a square, diamond, hexagon, disk, oval shape or any shape preferably having an axis of symmetry. The general shape of the ornamental plate advantageously corresponds to the shape of the interior space of the frame 1 with the play J being the only difference, but is not necessarily the same as the outside shape of the frame 1 (for example a disk-shaped plate—of which the periphery defined by the edge surface 23 is round—may be included in a frame of rectangular or square outside shape.

Furthermore, the aspects which the first and second faces 21, 22 present may be obtained in numerous ways, among which:

- a surface treatment, such as polishing, knurling, brushing or anodizing; or
- a covering chosen from: varnish, lacquer, paint, metal plating, leather, textile, plastic film; or
- an applied sheet having a surface treatment or a covering.

Other elements may be added to the buckle in order for example to enhance the aspect thereof. For example, a cap, typically of metal, may be formed on the frame in order to conceal the pivot 3 and more generally to confer the desired aspect to said frame 1. For example, the outside aspect of the frame conferred by such a cap may correspond to the aspect of one of the faces of the ornamental plate.

The belt buckle so developed enables modification of its aspect by turning over an ornamental plate between two positions in which the ornamental plate is locked in relation to a fixed frame. This modification of aspect is achieved simply and rapidly. The locking means employed enable this modification of aspect to be made repeatedly without the risk of deteriorating the frame of the buckle or the ornamental plate.

The invention claimed is:

1. A belt buckle comprising:

a frame (1) that defines an internal space;

an ornamental plate (2) disposed in the internal space (11) defined by said frame (1), the frame (1) comprising an open upper face (13) and an open lower face (14), the ornamental plate (2) comprising a first face (21) and a second face (22) which is an opposite face to the first face (21), wherein the ornamental plate (2) is connected to the frame (1) by a pivot (3) enabling said ornamental plate (2) to be turned over in the frame (1); and locking means configured to hold the ornamental plate (2) in position relative to the frame (1) in a first position exposing the first face (21) of the ornamental plate (2) through the open upper face (13) of the frame (1) and in a second position exposing the second face (22) of the ornamental plate (2) through said open upper face (13) of the frame (1), wherein the locking means comprise:

a first member projecting on an edge surface (23) of the ornamental plate (2), and a second member projecting on an interior rim (12) of the frame (1) delimiting the interior space (11) of the frame (1);

said first member and second member being configured to mechanically lock relative to each other by fitting together of their shapes, wherein the first member comprises a pin (4) projecting from the edge surface (23) of the ornamental plate (2), and wherein the second member comprises a cavity (51) for reception of said pin (4) provided in a protuberance (5) projecting on the interior rim (12) of the frame (1).

2. The buckle according to claim 1, wherein the pin (4) comprises a substantially hemispherical end (41).

3. The belt buckle according to claim 1, wherein, when the ornamental plate (2) is in the first or in the second position, play (J) is advantageously provided between a periphery of the ornamental plate (2) and the interior rim (12) of the frame (1), said play being configured to enable the ornamental plate to be turned over (2) without mechanical interference between the ornamental plate (2) and the frame (1), apart from between the first and second members of the locking means.

4. The belt buckle according to claim 1, comprising two locking means which, when the ornamental plate (2) is in the first or in the second position, are disposed along an axis at a right angle to the axis of the pivot (3) connecting the ornamental plate (2) to the frame (1).

5. The belt buckle according to claim 1, wherein the frame (1) comprises means for fastening the buckle to a belt strap, and means for closing the belt.

6. The belt buckle according to claim 5, the buckle being configured so as to be fastened by fastening means of the buckle to a belt strap (8) defining a longitudinal direction, wherein the pivot (3) is oriented along an axis at a right angle to the longitudinal direction.

7. The belt buckle according to claim 5, wherein the frame (1) comprises, on its lower face (14), a prong (6) configured to form fastening means of the buckle to a belt strap (8) and means for closing the belt.

8. The belt buckle according to claim 1, wherein the pivot (3) comprises two coaxial shafts (31, 32) penetrating via the edge surface (23) of the ornamental plate (2) into the thickness of said ornamental plate (2) which is situated between the first face (21) and the second face (22) of said ornamental plate (2).

9. The belt buckle according to claim 1, of which the first face (21) and the second face (22) of the ornamental plate (2) have different aspects that can be conferred by:

a surface treatment; or a covering (25) chosen from: varnish, lacquer, paint, metal plating, leather, textile, plastic film; or an applied sheet (24) having a surface treatment or a covering.

10. The belt comprising a buckle according to claim 1 and a belt strap (8) to which is fastened said buckle.

11. The belt buckle of claim 9, wherein the surface treatment comprises at least one of polishing, knurling, brushing, and anodizing.

12. A belt buckle comprising:

a frame (1) that defines an internal space, the frame (1) comprising an open upper face (13) and an open lower face (14);

an ornamental plate (2) disposed in the internal space (11) defined by said frame (1), the ornamental plate (2) comprising a first face (21) and a second face (22) which is an opposite face to the first face (21), wherein the ornamental plate (2) is connected to the frame (1) by a pivot (3) enabling said ornamental plate (2) to be turned over in the frame (1); and locking means configured to hold the ornamental plate (2) in position relative to the frame (1) in a first position exposing the first face (21) of the ornamental plate (2) through the open upper face (13) of the frame (1) and in a second position exposing the second face (22) of the ornamental plate (2) through said open upper face (13) of the frame (1), wherein the locking means comprise:

a first member projecting on an edge surface (23) of the ornamental plate (2), and a second member projecting on an interior rim (12) of the frame (1) delimiting the interior space (11) of the frame (1);

said first member and second member being configured to mechanically lock relative to each other by fitting together of their shapes, and wherein the first member comprises a pin reception cavity (51) provided in a protuberance (5) projecting from the edge surface of the ornamental plate (2), and the second member comprises a pin (4) projecting from the interior rim (12) of the frame (1).

* * * * *